US005216942A

United States Patent [19]

Sendoykas

[11] Patent Number: 5,216,942

[45] Date of Patent: Jun. 8, 1993

[54] PISTON LOCK FOR POWER CYLINDERS

[76] Inventor: Jack J. Sendoykas, 23510 Denton, Apt. 227T, Mt. Clemens, Mich. 48043

[21] Appl. No.: 846,933

[22] Filed: Mar. 6, 1992

[51] Int. Cl.[5] ..... F15B 15/26

[52] U.S. Cl. ..... 92/17; 92/20; 92/22; 92/28

[58] Field of Search ..... 92/17, 18, 15, 19, 20, 92/22, 28

[56] References Cited

U.S. PATENT DOCUMENTS

| | | | |
|---|---|---|---|
| 2,074,772 | 3/1937 | Brown . | |
| 2,130,618 | 9/1938 | Gnavi . | |
| 2,342,812 | 2/1944 | Martinson . | |
| 2,773,485 | 12/1956 | Geyer . | |
| 2,811,951 | 11/1957 | Bodem . | |
| 2,815,005 | 12/1957 | Geyer . | |
| 2,886,008 | 5/1959 | Geyer et al. . | |
| 2,918,786 | 12/1959 | Geyer . | |
| 2,970,573 | 2/1961 | Geyer . | |
| 2,974,638 | 3/1961 | Chace . | |
| 3,217,609 | 11/1965 | Royster . | |
| 3,451,313 | 6/1969 | Andersen . | |
| 3,576,151 | 4/1971 | Sendoykas | 92/24 |
| 3,603,212 | 9/1971 | Geyer | 92/17 |
| 3,668,977 | 6/1972 | Beidler | 92/17 |
| 3,732,783 | 5/1973 | Emenaker | 91/44 |
| 3,763,747 | 10/1973 | Beichel et al. . | |
| 3,785,249 | 1/1974 | Piroska | 92/17 X |
| 3,979,999 | 9/1976 | Emenaker | 92/17 X |
| 4,149,451 | 4/1979 | Axelsson | 92/17 |
| 4,168,865 | 9/1979 | Bogenschultz . | |
| 4,214,795 | 7/1980 | Kakuminato . | |
| 4,471,686 | 9/1984 | Garlapaty . | |
| 4,481,864 | 11/1984 | Peruzzi | 92/17 X |
| 4,790,234 | 12/1988 | Hampejs et al. | 91/362 |
| 5,020,418 | 6/1991 | Sendoykas | 92/17 |

FOREIGN PATENT DOCUMENTS

| | | | |
|---|---|---|---|
| 3033754 | 3/1982 | Fed. Rep. of Germany | 92/17 |
| 52-24680 | 2/1977 | Japan . | |
| 180806 | 10/1983 | Japan | 92/17 |
| 918593 | 4/1982 | U.S.S.R. | 92/17 |
| 224156 | 11/1924 | United Kingdom | 92/17 |
| 826036 | 12/1959 | United Kingdom | 92/17 |

*Primary Examiner*—Edward K. Look
*Assistant Examiner*—John Ryznic
*Attorney, Agent, or Firm*—Krass & Young

[57] ABSTRACT

A power cylinder of the type in which the piston may be locked to maintain am associated tool or clamp in a fixed position. A nut is provided in an end wall of the cylinder and the piston rod of the piston passes through the nut. The initial portion of the forward stroke of the piston is accomplished by the introduction of fluid pressure into the cylinder and, as the piston approaches the final portion of its stroke, the threaded portion of the piston rod engages the nut whereupon the nut is rotated to threadably advance the piston through the final portion of its stroke. The rotation of the nut is accomplished by pressurized fluid acting against a piston rack which rotates a gear which in turn rotates the nut. The center line of the piston rod is offset from the center line of the piston to preclude rotation of the piston and of the piston rod.

14 Claims, 4 Drawing Sheets

16
16a
16b
16c
16e
16f
16g
16h
16i 16
16a
16b
16d
16g
16h
16i 12
12d
3
2
10
63
14
14a
14b
14h
14i
14k
16
34
70
3
2

14
14a
14b
14f
14g
14h
14i
14j
14k
34

18
18c
18d 12
12d
14
14b
14c
14d
14f
14g
14i
14k
16
18
18b
18c
18d
18g
10a
50
50a
50b
50c
60
62
64
66
66a

PISTON LOCK FOR POWER CYLINDERS

BACKGROUND OF THE INVENTION

This invention relates to power cylinders operated by fluid pressure and more particularly to a fluid pressure power cylinder including means to securely lock the piston in a desired position of the piston.

Power cylinders, either pneumatically actuated or hydraulically actuated, find many applications in modern industry. For example, power cylinders are utilized to advance the slide of a tool head in a machine tool so as to bring the cutting tool to a position to operate on a workpiece. If the piston is not locked in its position of adjustment, the associated tool may bounce back and forth or chatter when it is moved against and into the work. As a further example, power cylinders are also conventionally used to operate work holding clamps. It is essential in these situations that the cylinder hold the workpiece securely and that it maintain a holding force on the work, sometimes for long periods of time and sometimes regardless of variations in the size of the work due to permissible work tolerances or other factors. For example, parts such as aircraft wings or the like are sometimes clamped in position and left for days while different machining and assembling operations are performed thereon. It is important in these cases that the power clamps used to hold the part maintain full pressure continuously and that pressure not be relieved or even reduced appreciably at any clamp during the entire period.

It is important therefore, in these and other applications, that the power cylinder include means to ensure that the piston, and thereby the associated tool or clamp, maintains its position of adjustment irrespective of forces exerted against the associated tool or clamp and irrespective of pressure losses in the cylinder.

Various devices have been proposed to allow the piston to be locked in its position of adjustment. One such device, shown in U.S. Pat. No. 3,576,151, includes a ring which is rotated following movement of the piston to its full stroke position to engage pins carried by the piston and thereby lock the piston in its position of adjustment irrespective of any subsequent loss of pressure in the system. Whereas this piston lock arrangement has been generally satisfactory, it does not provide the ability to lock the piston over any significant range of piston positions but rather provides locking only in the full stroke position of the piston.

A further such device, shown in U.S. Pat. No. 5,020,418, allows locking of the piston over a significant range of piston positions but achieves this range of locking in a design that is relatively complex and therefore relatively expensive to produce.

SUMMARY OF THE INVENTION

The present invention is directed to the provision of a power cylinder having an improved piston lock arrangement which allows locking of the piston over a significant range of piston positions.

More specifically, the present invention is directed to the provision of a power cylinder providing locking of the piston over a significant range of piston positions and utilizing a structure that is simple, effective and inexpensive.

The power cylinder of the invention is of the type including a housing defining an axially extending bore closed by end walls, a piston mounted for reciprocal axial movement in the bore, and a piston rod connected to the piston and extending axially out of the bore through one of the end walls. According to the invention, the piston rod includes a threaded portion and passes through a nut positioned in the one end wall and means are provided to rotate the nut so that the nut may threadably engage the threaded portion of the piston rod to move the piston axially in the bore. This simple arrangement allows the piston to move initially under fluid pressure in the bore until it reaches an approximation of its final position whereafter the final positioning of the piston may be achieved by rotation of the nut which acts in threaded coaction with the threaded portion of the piston rod to move the piston lockingly and precisely to its final position.

According to a further feature of the invention, the piston rod passes through the front end wall of a power cylinder, the threaded portion of the piston rod is proximate the piston, and the piston rod further includes a smooth shank portion extending forwardly from the threaded portion and forwardly beyond the front end wall for engagement with a workpiece. This arrangement allows the smooth shank portion of the piston rod to pass slidably through the nut during the fluid pressure portion of the forward movement of the piston whereafter, as the threaded portion of the piston rod engages the nut, the nut may be rotated to threadably and lockingly move the piston rod to its final position.

According to a further feature of the invention, the nut is rotated in response to pressure fluid. This arrangement allows the same pressure fluid being used to move the piston rod through the first portion of its stroke to also be used to rotate the nut to achieve the final precise locking positioning of the piston rod.

In the disclosed embodiment of the invention, the nut rotating means includes gear means on the periphery of the nut and a gear train driving the gear means on the nut. The gear train includes a rack, a pinion driven by the rack, and a gear driven by the pinion and drivingly engaging the gear means on the nut. Pressurized fluid is directed against the rack to actuate the gear train and thereby rotate the nut to axially move the piston to its final locking position

DETAILED DESCRIPTION OF THE PREFERRED EMBODIMENT

Figures 1, 7, 8, 9, 10:
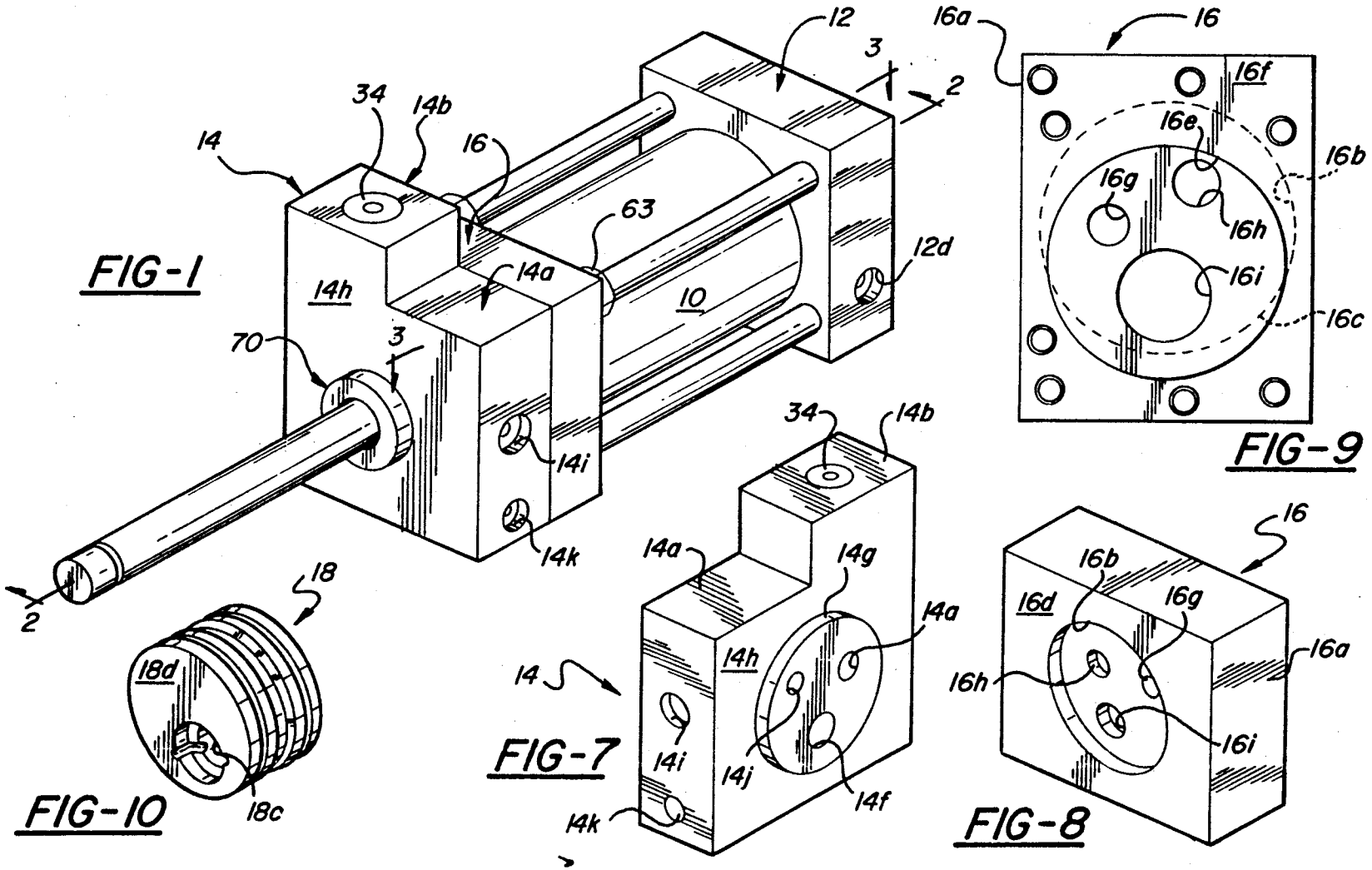
FIG. 1 is a perspective view of the invention power cylinder.
FIG. 7 is a perspective view of a front head employed in the invention power cylinder.
FIG. 8 is a perspective view of an adaptor block employed in the invention power cylinder.
FIG. 9 is a rear view of the adapter block.
FIG. 10 is a perspective view of a piston employed in the invention power cylinder.

The power cylinder of the invention includes a cylinder body 10, a rear head 12, a front head 14, an adapter block 16, a piston 18, a piston rod 20, a nut 22, and a gear train 24.

All of the parts of the invention power cylinder, unless otherwise indicated, are formed of a suitable steel material.

Cylinder body 10 has a tubular configuration and defines a tubular main body portion 10*a* and a central bore 10*b*.

Rear head 12 has a rectangular monolithic configuration and includes a main body portion 12*a*, a circular recess 12*b* sized to receive the rear annular end 10*c* of cylinder body 10 and centered on cylinder body centerline 30, a further, counter, recess 12*c* centered on a centerline 32 offset downwardly from centerline 30, and a cross bore 12*d* extending transversely through the rear head and intersecting recess 12*c*.

Front head 14 also has a rectangular monolithic configuration and includes a main body portion 14*a*, a tower portion 14*b*, a bore 14*c* extending downwardly in tower portion 14*b* are closed at its upper end by a cap 34, a cross bore 14*d* intersecting bore 14*c* but displaced laterally from cross bore 14*d*, a counter bore 14*e*, a bore 14*f* intersecting bore 14*c* but displaced laterally from bore 14*c* and laterally and downwardly from bore 14*d*, a circular hub portion 14*g* projecting rearwardly from the rear face 14*h* of the front head, a cross bore 14*i* communicating with an axial bore 14*j* opening in boss 14*g*, and a cross bore 14*k* extending transversely through front head 14 and intersecting the lower end of bore 14*c*.

Adapter block 16 has a rectangular monolithic configuration corresponding generally to the configuration of the main body portion 14*a* of front head 14 and includes a main body portion 16*a*, a circular recess 16*b* in the rear face 16*d* of the adapter block sized to receive hub portion 14*g* of front head 14, a circular recess 16*e* in the front face 16*f* of the adapter block sized to receive the front annular end 10*d* of cylinder body 10, and through axial bores 16*g*, 16*h* and 16*i* extending through the adapter block in the common area bounded by recesses 16*b* and 16*e*.

Piston 18 has a circular cylindrical configuration sized to fit slidably within bore 10*b* and includes an axial bore 18*a*, a counterbore 18*b*, a further counterbore 18*c* opening in the front face 18*d* of the piston, and a further counterbore 18*e* opening in the rear 18*f* face of the piston. A plurality of annular grooves in the outer periphery of the piston respectively receive elastomeric seals 40 and an annular wear ring 42. Axially extending diametrically opposed slots 18*g* open in the front piston face 18*d* and extend rearwardly within the piston to a location within counterbore 18*b*.

Piston rod 20 includes a rear reduced diameter threaded portion 20*a*, a pilot portion 20*b*, a threaded portion 20*c*, a smooth shank portion 20*d*, and a workpiece engaging front end portion 20*e*.

Nut 22 includes a main body annular portion 22*a* having internal threads 22*b* sized to threadably engage threaded portion 20*c* of piston rod 20. Gear teeth 22*c* are provided on the exterior periphery of main body portion 22*a*.

Gear train 24 includes a piston rack 50 of circular configuration sized to fit slidably in front head bore 14*c* and a compound gear 52.

Piston rack 50 includes a main body portion 50*a* and a rack portion 50*b* defined by gear teeth 50*c*. Annular seal grooves at either end of the main body portion of the piston rack receive elastomeric O-ring seals 60.

Compound gear 52 includes a shaft 52*a*, a pinion gear 52*b*, a drive gear 52*c*, and front and rear journals 52*d* and 52*e*.

In the assembled relation of the invention power cylinder, cylinder body 10 is clamped between rear head 12 and adapter block 16 with the rear annular edge 10*c* of the cylinder body received in recess 12*b*, the front annular edge 10*d* of the cylinder body received in recess 16*e*, and the elements 10, 12 and 16 maintained in a clamped relationship by tie rods 60 passing through apertures in rear head 12 for engagement by nuts 62 and threadably engaging at their forward ends in adapter block 16 and locked against the adaptor block by nuts 63; piston 18 is slidably received in cylinder body bore 10*b*; front head 14 is suitably secured to the front face of adapter block 16 as by screw 64; pilot portion 20*b* of piston rod 20 is received in piston bore 18*b* with reduced diameter threaded portion 20*a* passing through piston bore 18*a* for locking engagement by nuts 64 and with the piston rod precluded from rotation relative to the piston by a dowel pin 66 passing through an aperture 20*f* in the pilot portion 20*b* of the piston rod and slidably engaging at its opposite ends 66*a* in the slots 18*g* in the piston; the smooth shank portion 20*d* of the piston rod passes slidably through axial bore 14*f* in front head 14 and slidably through a bearing 70 secured as by screws 72 to the front face 14*h* of front head 14 to position the work engaging end portion 20*e* of the piston rod forwardly of the front head for coaction with a workpiece W; piston rack 50 is slidably received in bore 14*c*; compound gear 52 is mounted for rotation with front journal 52*d* received in a bushing 72 positioned in front head bore 14*e*, rear journal 52*e* received in a bushing 74 positioned in adaptor block bore 16*h*, pinion gear 52*b* meshingly engaging the teeth 50*c* of piston rack 60, and drive gear 52*c* mounted for rotation in the chamber 76 defined by recess 16*c* in the front face of adapter block 16; and nut 22 is mounted for rotation in bore 16*i* of adapter block 16 with its gear teeth 22*c* in meshing engagement with the teeth of drive gear 52*c* and with the nut precluded from axial movement by thrust bearings 80 and 82. Note that, in the assembled relation of the power cylinder, piston 18 is centered on centerline 30 and piston rod 20 and nut 22 are centered on centerline 32 displaced downardly from center line 30.

Figure 2:
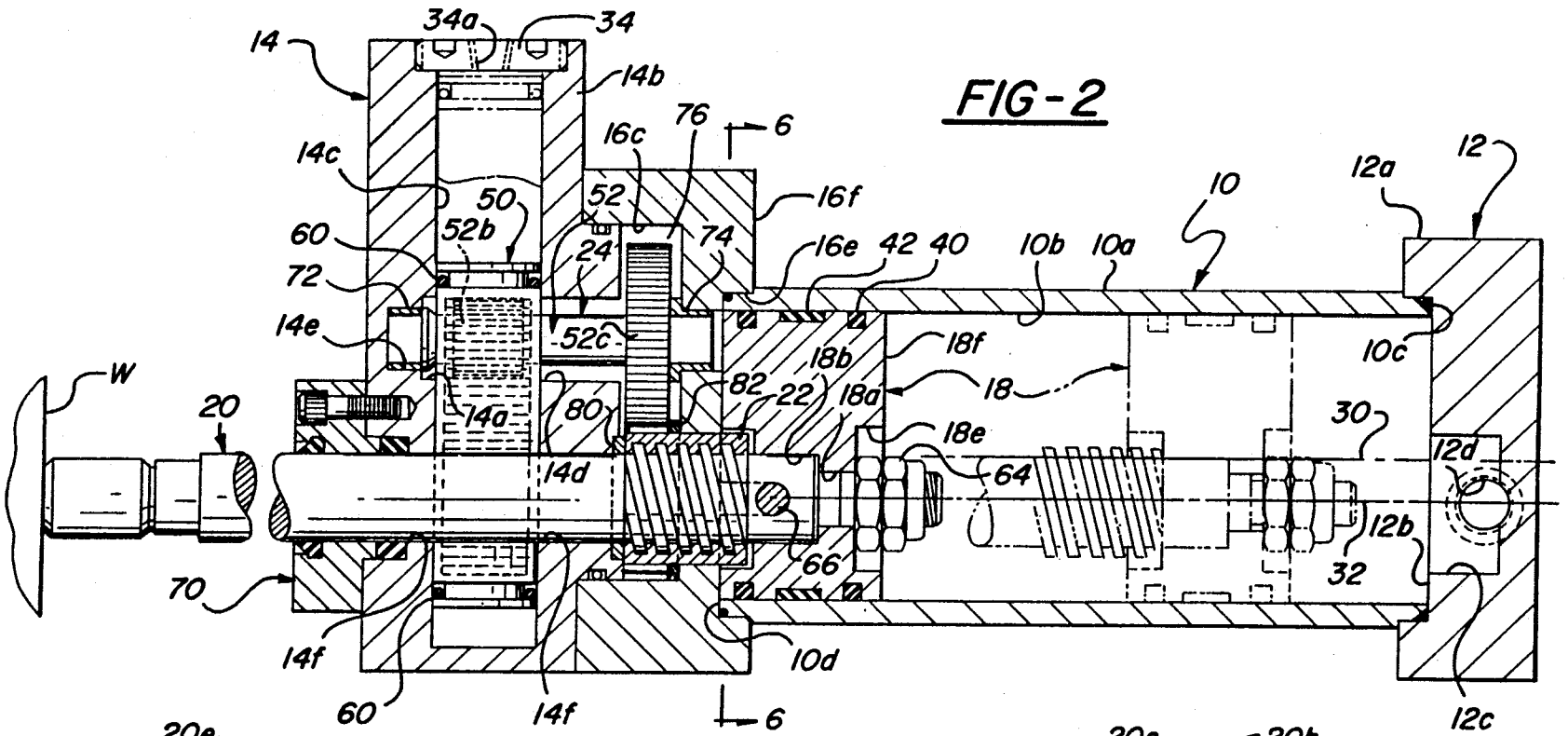
FIGS. 2 and 3 are cross sectional views taken respectively on lines 2—2 and 3—3 of FIG. 1.
Figure 11:
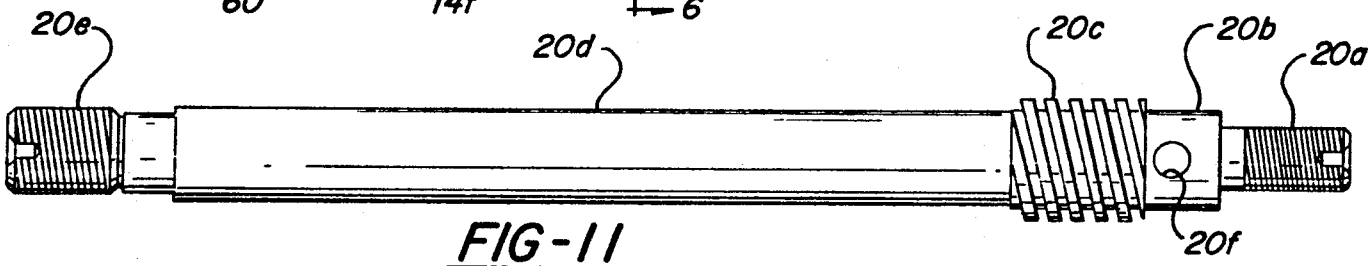
FIG. 11 is a view of a piston rod employed in the invention power cylinder.
Figure 3:
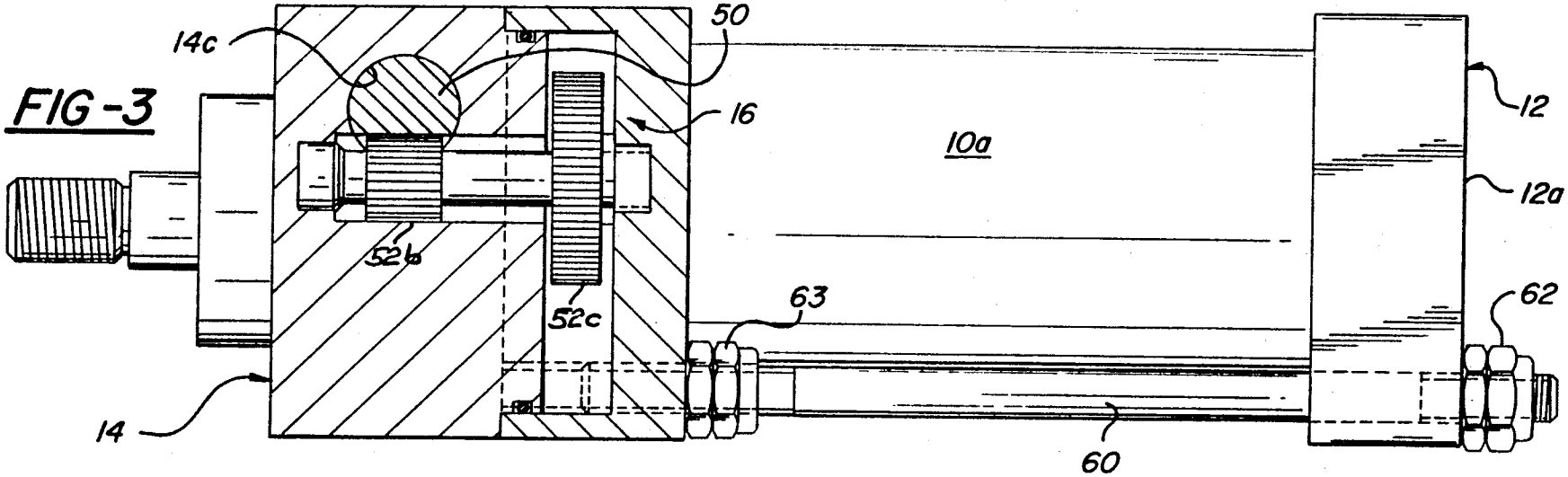
Figure 17:
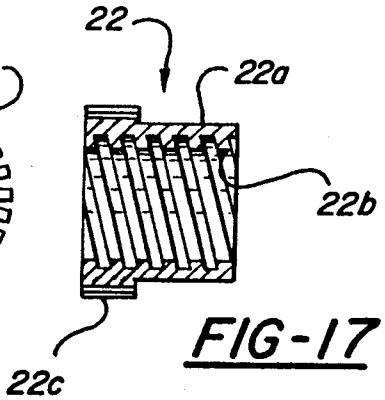
FIGS. 16 and 17 are detailed views of a nut employed in the invention power cylinder.
Figure 16:
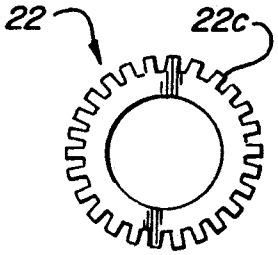
Figure 15:
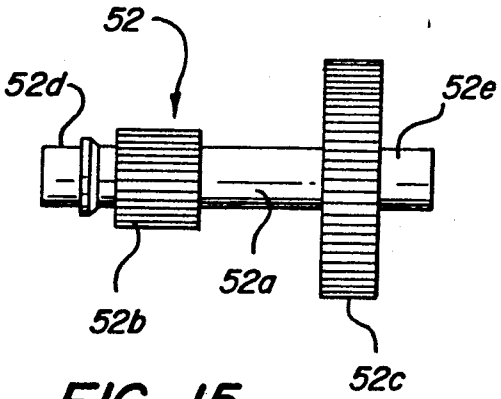
FIGS. 14 and 15 are detailed views of a compound gear employed in the invention power cylinder.
Figure 14:
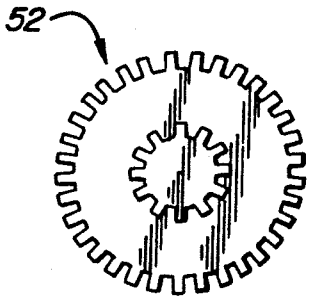
Figures 4, 5, 6, 12, 13:
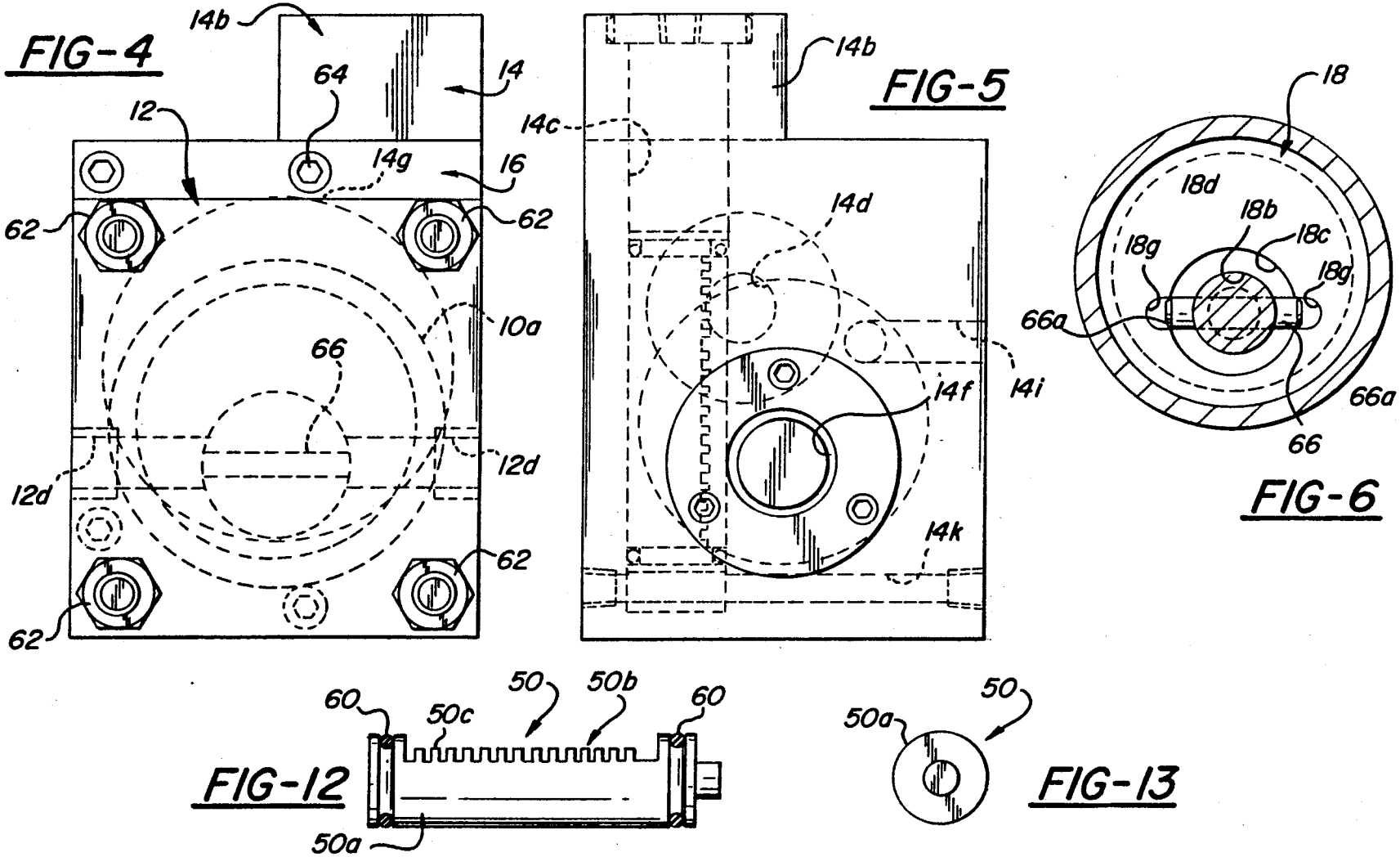
FIG. 4 is a rear view of the invention power cylinder.
FIG. 5 is a front view of the invention power cylinder.
FIG. 6 is a cross sectional view taken on line 6—6 of FIG. 2.
FIGS. 12 and 13 are detailed views of a piston rack employed in the invention power cylinder.

In operation, and with piston 18 in the dotted line position of FIG. 2 proximate rear head 12 and rack piston 50 in the dotted line position of FIG. 2 proximate the upper end of bore 14*c*, pressure fluid is introduced from either end of bore 12*d* (with the other end plugged) to act against the rear face 18*f* of the piston 18 and move the piston axially forwardly in bore 10*b* with the fluid forwardly of the piston exhausting from bore 10*b* through aligned bores 16*g* and 14*j* and then through cross bore 14*i*. As the piston approaches the forward end of bore 10*b* proximate adapter block 16, the threaded portion 12*c* of piston rod 20 engages the rear end of nut 22, whereafter pressure fluid is supplied to bore 14*c* through central port 34*a* in end cap 34 to drive piston rack 50 downwardly in bore 14*c* (while exhausting fluid from bore 14*c* through one end of bore 14*k* with the other end plugged) to thereby rotate pinion 52*b*, gear 50*c* and nut 22.

As nut 22 is rotated, the piston rod is drawn forwardly into the nut to advance the piston through the last portion of its stroke. The extent of forward movement of the piston will typically be determined by contact of the forward end 20*e* of the piston rod with an associated workpiece W. That is, the forward threaded movement of the piston in response to rotation of nut 22 continues until engagement is made with the workpiece W at which point the piston will be locked in its final position of adjustment by the inter engagement of the threads of the nut and the threads on the piston rod so that the piston rod will hold its final position of adjustment irrespective of forces of pressure losses in the cylinder. The admission of pressure fluid to bore 10*b* to act against piston face 18*f* is continued during the forward threaded movement of the piston so that the fluid pressure in bore 12*c* serves as an assist or "helper" force to facilitate the threaded engagement of the nut and the threaded piston portion. After the piston has reached its final position of threaded locking adjustment, the admission of pressure fluid is discontinued to both bore 12*b* and bore 14*c*. Note that rotation of piston 18 about center line 30 and rotation of piston rod 20 about center line 32 are precluded by the off center mounting of piston rod 20 relative to piston 18.

When the cylinder is no longer needed to perform its workpiece positioning or clamping function, fluid pressure is introduced into bore 14*i* to pass through bores 14*j* and 16*j* to act against the front face 18*d* of the piston (while exhausting fluid through port 12*d*) and pressure fluid is simultaneously introduced into one end of bore 14*k* (while exhausting fluid through port 34*a*) so as to move rack piston 50 upwardly in bore 14*c* and rotate pinion 52*b*, gear 52*c* and nut 22 in a sense to threadably withdraw the piston rod, and thereby the piston, from the workpiece so that the piston moves in bore 10*b* toward rear head 12 until the threaded portion 20*c* of the piston rod disengages from nut 22, whereafter the delivery of pressure fluid to bore 12*c* is discontinued and the pressure fluid acting against the front side 18*d* of piston 18 moves the piston to its dotted line retracted position seen in FIG. 2 preparatory to another work operation. Note that the fluid pressure force acting on the front side 18*d* of the piston serves as an assist or "helper" force to facilitate the threaded, withdrawing movement of piston 18 under the instigation of nut 22.

It will be understood that a suitable source of pressurized fluid and suitable valving means will be provided to enable pressurized fluid to be selectively directed to bores 14*i*, 12*d*, 34*a* and 14*k* to selectively move the piston forwardly and rearwardly during the pressure portions of its stroke and selectively move piston rack 50 up and down in bore 14*c* to accomplish the threaded movement of the piston rod under the actuation of nut 22.

The invention will be seen to provide a power cylinder with a piston lock wherein the locking condition may be achieved over a relatively long range of axial movement of the piston and wherein the lock, in any position of locking adjustment, is positive and firm and will hold the associated tool or clamp without need to maintain pressure in the pressure chamber of the power cylinder. The invention will further be seen to provide these advantages in a power cylinder of extremely simple and inexpensive construction.

Whereas a preferred embodiment of the invention has been illustrated and described in detail, it will be apparent that various changes may be made in the disclosed embodiment without departing from the scope or spirit of the invention.

I claim:

1. A power cylinder of the type including a housing defining an axially extending bore closed by end walls, a piston mounted for reciprocal axial movement in the bore, fluid pressure means for moving said piston, and a piston rod connected to the piston and extending axially out of the bore through one of the end walls, characterized in that the piston rod includes a threaded portion and passes through a nut positioned in the one end wall and means are provided to rotate the nut so that the nut may threadably engage the threaded portion of the piston rod to move the piston axially in the bore.

2. A power cylinder according to claim 1 wherein the nut rotating means comprises gear means on the periphery of the nut and a gear train driving the gear means on the nut.

3. A power cylinder according to claim 2 wherein the gear train includes a rack, a pinion driven by the rack, and a gear driven by the pinion and drivingly engaging the gear means on the nut.

4. A power cylinder according to claim 3 wherein the power cylinder further includes means for directing pressurized fluid against the rack to actuate the gear train and rotate the nut to axially move the piston.

5. A power cylinder according to claim 1 wherein the piston rod passes through the front end wall of the power cylinder, the threaded portion of the piston rod is proximate the piston, and the piston rod further includes a smooth shank portion extending forwardly from the threaded portion and forwardly beyond the front end wall for engagement with a workpiece

6. A power cylinder according to claim 5 wherein the power cylinder further includes means for introducing pressurized fluid into the cylinder bore rearwardly of the piston so as to provide fluid pressure forward movement of the piston in the bore until the threaded portion of the piston rod engages the nut whereafter the rotating means may be actuated to rotate the nut and provide further threaded forward movement of the piston in the bore.

7. A power lock cylinder comprising:

a housing defining a bore closed by end walls;

a piston mounted for reciprocal movement in the bore;

fluid pressure means for moving said piston, a piston rod connected to the piston, extending out of the bore through one of the end walls, and including a threaded portion;

a nut surrounding the piston rod and precluded from axial movement; and means operative to rotate the nut so that the nut may threadably engage the threaded portion of the piston rod and move the piston rod and the piston axially.

8. A power cylinder according to claim 7 wherein:

said operative means includes gear means on the periphery of the nut and a gear train drivingly engaging the gear means on the nut to rotate the nut.

9. A power cylinder according to claim 8 wherein the gear train includes a rack, a pinion, and a gear driven by the pinion and drivingly engaging the gear means on the nut.

10. A power cylinder according to claim 9 wherein the cylinder further includes means for directing pressurized fluid against the rack to actuate the gear train.

11. A power cylinder according to claim 7 wherein the piston rod passes through the front end wall of the power cylinder, the threaded portion of the piston rod is proximate the piston, and the piston rod further includes a smooth shank portion extending forwardly from the threaded portion and forwardly beyond the front end wall for engagement with a workpiece.

12. A power cylinder according to claim 11 wherein the power cylinder further includes means for introducing pressurized fluid into the cylinder bore rearwardly of the piston so as to provide fluid pressure forward movement of the piston in the bore until the threaded portion of the piston rod engages the nut whereafter the rotating means may be actuated to rotate the nut and provide further threaded forward movement of the piston in the bore.

13. A power cylinder according to claim 12 wherein the nut is rotated in response to pressurized fluid.

14. A power cylinder according to claim 7 wherein the piston is positioned on a center line that is laterally displaced from the center line of the cylinder bore and is precluded by the one end wall from any but axial movement on its center line, whereby to preclude rotation of the piston and of the piston rod.

* * * * *

UNITED STATES PATENT AND TRADEMARK OFFICE

CERTIFICATE OF CORRECTION

PATENT NO. : 5,216,942

DATED : June 8, 1993

INVENTOR(S) : Jack J. Sendoykas

It is certified that error appears in the above-indentified patent and that said Letters Patent is hereby corrected as shown below:

Column 5, line 15, after "forces" insert --exerted against the associated workpiece and irrespective--.".

Signed and Sealed this

Twenty-second Day of February, 1994

Bruce Lehman

*Attest:*

BRUCE LEHMAN

*Attesting Officer*

*Commissioner of Patents and Trademarks*